United States Patent [19]

Leibowitz

[11] 4,454,720

[45] Jun. 19, 1984

[54] HEAT PUMP

[75] Inventor: Herman M. Leibowitz, Schenectady, N.Y.

[73] Assignee: Mechanical Technology Incorporated, Latham, N.Y.

[21] Appl. No.: 360,779

[22] Filed: Mar. 22, 1982

[51] Int. Cl.[3] ..... F01K 17/00

[52] U.S. Cl. ..... 60/648

[58] Field of Search ..... 62/238.4, 510, 501, 62/79, 238.5; 60/648, 653; 237/2 B

[56] References Cited

U.S. PATENT DOCUMENTS

| | | | |
|---|---|---|---|
| 3,394,555 | 7/1968 | LaFleur | 62/238.4 X |
| 3,416,318 | 12/1968 | Chocquet | 60/648 X |
| 4,249,384 | 2/1981 | Harris | 60/670 |
| 4,323,109 | 4/1982 | Jaster | 237/2 B |
| 4,342,201 | 8/1982 | Ishii | 62/238.4 |

OTHER PUBLICATIONS

L. S. Harris, Improvements in Steam Desuperheater Performance, ASME Publication, 1974.

*Primary Examiner*—Lloyd L. King

*Attorney, Agent, or Firm*—Joseph V. Claeys; Arthur N. Trausch, III

[57] ABSTRACT

An open Rankine cycle heat pump that utilizes a multistage compressor having interstage desuperheating wherein process fluid in the form of water drawn from a waste heat producing process is used as the working fluid in the heat pump thereby eliminating the need for heat exchangers at the conventional evaporator and condensor locations. Heated return water drawn from the process is flashed to a vapor and the vapors passed through the compressor to provide thermal energy that is used in compatible process related equipment.

12 Claims, 2 Drawing Figures

HEAT PUMP

BACKGROUND OF THE INVENTION

This invention relates to a heat pump for recovering usable thermal energy in an industrial process and, in particular, to an industrial heat pump that utilizes an open Rankine cycle.

In many industrial heat pump applications, a heated effluent generated by an industrial process is employed to evaporate a refrigerant moving through a closed loop heat pump circuit. Heat is transferred from the effluence to the working fluid (refrigerant) of the heat pump through means of a heat exchanger generally referred to as an evaporator. The refrigerant is selected so that it will boil at a temperature that is slightly below the process effluent temperature whereby the refrigerant undergoes a phase transformation in the heat exchanger. The refrigerant vapor is then compressed to a higher state and the energy stored in the fluid is passed out of the system by means of a second heat exchanger called a condenser. The refrigerant, which is now mostly in a liquid phase, is throttled to saturation and the cycle is repeated.

Although relatively expensive heat exchangers are used in closed circuit heat pumps, a temperature gradient is established over the heat transfer surfaces of both the evaporator and the condenser which reduces the overall efficiency of the system. By the same token, a relatively large amount of energy is consumed in moving both the process fluid and the refrigerant through the heat exchangers. These parasitic losses also reduce the efficiency of the system.

To reduce compressor work, and thus increaase the COP of the heat pump system, the compressor is sometimes staged and the compressed vapor cooled as it moves between stages. Interstage cooling is usually carried out in a water cooled heat exchanger that consumes relatively large amounts of liquid. Process gases passing through the exchanger experience unwanted pressure losses and, here again, the initial cost of the equipment is relatively high.

In order for an industrial heat pump to be cost effective, its efficiency must be relatively high. When fuel prices are comparatively low, the industrial heat pump does not compete favorably with alternative heating methods. However, with the rapid increase in fuel prices, waste heat recovery systems such as the industrial heat pump is becoming more attractive and any small increase in the overall efficiency of the system helps in attaining the ultimate commercial realization of this type of equipment.

SUMMARY OF THE INVENTION

It is therefore an object of this invention to improve heat pumps.

A still further object of the present invention is to improve heat pumps suitable for use in industrial processes wherein normally wasted heat can be recovered in a form that can be use in process related equipment.

Another object of the present invention is to reduce the cost of equipment required in an industrial heat pump system.

A further object of the present invention is to provide an improved Rankine cycle heat pump system in which heat exchangers are eliminated from the system.

A still further object of the present invention is to provide a heat pump system that utilizes steam or water drawn from an industrial process as the working fluid in the heat pump circuit.

Another object of the present invention is to provide an open Rankine cycle heat pump utilizing multistage compression having interstage desuperheating.

Yet another object of the present invention is to reduce parasitic losses in a heat pump system and thus increase the thermodynamic efficiency of the system.

A still further object of the present invention is to reduce the amount of compressor work required in an open Rankine cycle heat pump.

These and other objects of the present invention are attained by means of a heat pump system for recovering normally wasted heat from an industrial process and using the recovered thermal energy in compatible process related equipment. Heated water is drawn from the process and the water is flashed to a vapor in a flash tank. The suction end of a multistage compressor is connected to the tank and the generated vapors are passed through the compressor to develop steam in a form that is usable in the process. A liquid coolant is sprayed into the compressed vapors as they are moving between stages to remove any superheat therefrom thus reducing the work of compression.

BRIEF DESCRIPTION OF THE DRAWINGS

For a better understanding of these and other objects of the present invention reference is had to the following detailed description of the invention which is to be read in conjunction with the associated drawings wherein.

DESCRIPTION OF THE INVENTION

Figure 1:
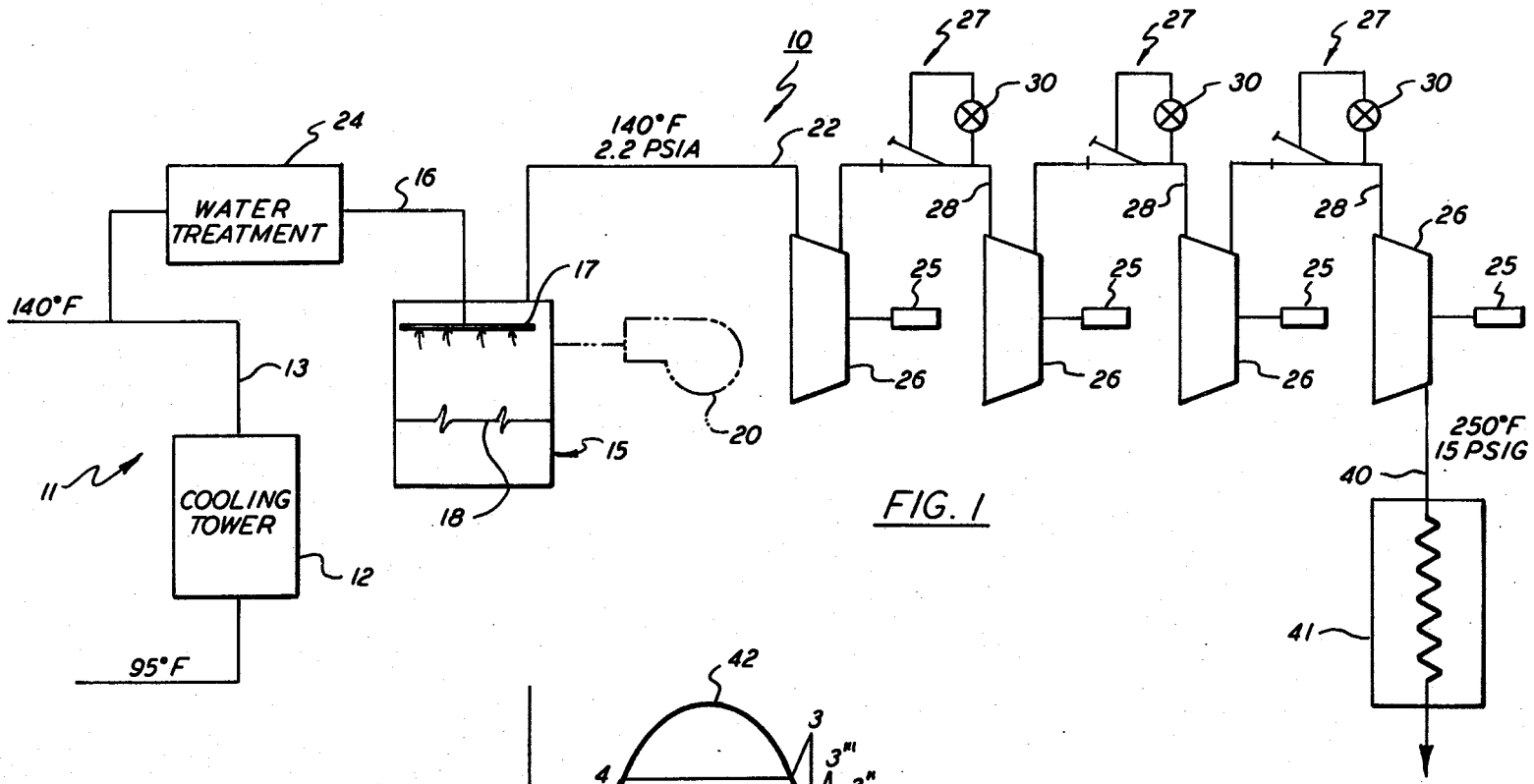
FIG. 1 is a schematic representation of an open Rankine cycle heat pump that embodies the teachings of the present invention.

Turning now to the drawings, there is illustrated in FIG. 1 an industrial heat pump 10 that is operatively connected to an access loop 11 of an industrial heat process which normally delivers large amounts of heated waste or effluent water to a cooling tower 12 where excess heat stored in the effluent water is discharged to the atmosphere. The water leaving the cooling tower is at 95° F. and can be reused elsewhere in the plant for cooling purposes. A typical process of this type can be found in the petrochemical industry. Accordingly, recovery of the typically wasted energy by heat pumping to at least 15 psig steam could be used in the process to heat distillation chambers or other similar processes that require low pressure steam. The 140° F. waste water itself is of little use at this temperature (140° F.) in the plant.

A portion of the waste process water is diverted from the cooling tower by feed line 13 and brought into the heat pump 10 of the present invention where it is utilized as the working fluid to move energy from the low temperature side of the pump to the high temperature side thereof. Accordingly, a good deal of expensive heat transfer equipment as typically used in the evaporator and condensor sections can be eliminated thus realizing a savings in both money and efficiency. Elimination of these heat exchangers also results in a reduction in pressure and parasitic pumping losses that is generally associated with this type of equipment. By opening the system as herein shown, the overall volumetric flow through the system also can be considerably reduced which in some cases can be as high as fifty percent when compared to the more conventional closed loop system.

That portion of the process water diverted from the access loop 11 is delivered into a flash tank 15 at 140° F. by means of a supply line 16. Water entering the tank is distributed to a spray bar 17 situated in the top portion of the tank well above the liquid level line 18. The bar contains a plurality of nozzles through which the diverted water is introduced into the tank. The pressure inside the tank is reduced to a pressure below the saturation pressure of the 140° F. effluent water by any suitable means. This will result in at least a portion of the water issuing from the nozzles to be flashed to steam at subatmospheric pressure. Condensate is collected in the bottom of the tank and is returned to the access loop upstream of the cooling tower by return line 19. The pressure in the tank can be drawn down by means of a vacuum pump 20 or by simply connecting the vapor chamber of the tank to the suction end 22 of the compressor 26.

Many waste heat processes produce water that contains unwanted contaminants which adversely affect the operation of the heat pump. The contaminants can be in the form of suspended particles or dissolved chemicals depending upon the nature of the process. Accordingly, it may be necessary or desirable to provide a water treatment unit 24 in the feed line 16 which functions to remove unwanted contaminants from the water or minimally bring the contamination down to an acceptable operating level.

The compressor utilized in the instant heat pump is a multistage machine containing four stages of compression 26—26. Its purpose is to compress the subatmospheric vapor (steam) to a temperature and pressure that makes it useable in a process. Normally 15 psig steam for example is adequate for distillation purposes. Vapor generated in the flash tank is drawn directly into the first stage by means of a suction line 22. Each compressor stage contains a separate drive motor 25—25. It should be clear to one skilled in the art, however, that the number of stages and manner of driving each stage can be altered without departing from the teachings of the invention. A desuperheater 27—27 is operatively positioned in each of the connecting lines 28—28 running between stages. The desuperheaters are each arranged to inject a fine spray of atomized liquid coolant into the vapor flow moving through the line to reduce the vapor to a dry saturated state. Desuperheating between each stage improves the compression efficiency thereby reducing the work required to produce a given amount of steam at a specified pressure. Each desuperheater unit is provided with a downstream sensor 30 that monitors the condition of the vapor and regulates the amount of coolant added to the flow in response thereto. In the present embodiment of the invention, water is used as the coolant media. Desuperheating equipment of the type herein described which is capable of spraying atomized droplets of coolant into the flow without appreciable pressure loss is available through the Yarway Corporation of Bluebell, Pa. and others.

The steam discharged from the last stage of the compressor is carried by exaust line 40 to a suitable process related distribution loop 41 which might be a distillation chamber or other similar type of process or equipment that is compatible with this type of heat source i.e. positive pressure (15–50 psig) steam.

Figure 2:
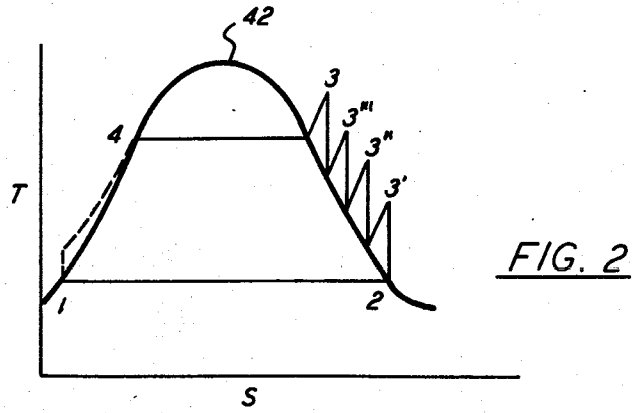
FIG. 2 is a T-s diagram of the heat pump cycle illustrated in FIG. 1.

The nature of the entire open Rankine heat pump cycle is illustrated by the T-s diagram as shown in FIG. 2. This diagram contains, in graphic form, the properties of the working substance as taken from the steam tables. Initially the water at an elevated temperature is drawn from the waste heat process at state point 1 and is flashed to steam at a lower pressure at state point 2. This steam is drawn from the flash tank by the compressor and is pumped in stages to state point 3. As can be seen, vapor leaving each stage is in a superheated condition as depicted by state points 3', 3'' and 3'''. Through use of the described desuperheater, the steam is brought down to the saturated vapor line thus considerably reducing the amount of overall work that the compressor is required to perform. Upon being discharged from the compressor, the high temperature steam is delivered to the distribution loop. Because the working fluid is in the form of saturated steam, heat can be directly extracted therefrom when utilized in many known processes. Depending upon the process, the vapor is brought to a saturated liquid at, for example, state point 4 and returned to either atmosphere or to the waste heat process where it can be recycled.

While this invention has been described with reference to the embodiment herein disclosed, it should be evident that the present invention is broad enough to cover any modifications that come within the scope of the following claims.

I claim:

1. The method of recovering energy from an industrial process containing a heated waste fluid that includes the steps of:

removing a portion of said heated waste fluid from the high temperature side of said process;

flashing at least a portion of the removed heated waste fluid to a vapor;

passing said vapor in series through a multistage compressor wherein the vapor is superheated within each stage;

desuperheating the vapor leaving each compressor stage to a dry saturated state by spraying a liquid coolant into said vapor; and employing the vapor leaving the last stage of compression to provide thermal energy to compatible process related equipment.

2. The method of claim 1 that includes the further step of removing harmful contaminants from the heated waste fluid before flashing the fluid.

3. The method of claim 1 wherein the heated waste fluid and the coolant are both water.

4. The method of claim 1 wherein the flashing step is carried out by spraying high temperature process fluid into a pressurized tank.

5. The method of claim 4 that includes the further step of returning fluid collected in the tank to the process.

6. The method of claim 4 that includes the further step of connecting the tank to the suction side of the first stage of the compressor to reduce the pressure therein.

7. The method of claim 1 wherein the coolant is atomized into finely divided droplets as it is sprayed into the vapor.

8. A heat pump for removing usable energy from a process of the type which generates a heated process fluid that includes:

a supply line for bringing heated process fluid from the process equipment to a low pressure flash tank whereby at least a portion of the fluid is flashed to a vapor;

a multistage compressor in a series configuration for raising the temperature and pressure of said vapor, said multistage compressor arranged so that vapor collected in the flash tank is drawn into the suction side of a first stage; and desuperheater means connected to the discharge side of each compressor stage for reducing the temperature of vapor leaving each stage to a dry saturation pressure.

9. The apparatus of claim 8 wherein said desuperheater means includes a spray head for injecting an atomized spray of coolant directly into a connecting line for delivering vapor from the discharge side of one stage to the suction side of the next stage.

10. The apparatus of claim 8 that further includes treatment means for removing contaminants from the process fluid prior to introducing the fluid to the flash tank.

11. The apparatus of claim 9 wherein the process fluid and the coolant are both water.

12. The apparatus of claim 8 that further includes process related equipment connected to the last stage of compression that is capable of directly utilizing the thermal energy in the compressor discharge vapor.

* * * * *